US005387075A

United States Patent [19]

Aoki

[11] Patent Number: 5,387,075

[45] Date of Patent: Feb. 7, 1995

[54] LATCHING MECHANISM FOR A FRONT END LOADING TRACTOR

[76] Inventor: Tuyoshi Aoki, 3-13-3, 504 Niwashirodai, Sakai-shi, Osaka, Japan

[21] Appl. No.: 20,812

[22] Filed: Feb. 22, 1993

[30] Foreign Application Priority Data

Feb. 26, 1992 [JP] Japan ..... 4-039724

[51] Int. Cl.[6] ..... E02F 9/00

[52] U.S. Cl. ..... 414/686; 414/723; 37/468; 172/272; 403/322

[58] Field of Search ..... 414/723, 686; 403/321, 403/322, 325; 172/272-275; 37/468

[56] References Cited

U.S. PATENT DOCUMENTS 4,846,624 7/1989 Hohn ..... 414/723
4,984,958 1/1991 Kaczmarczyk ..... 414/723
4,986,722 1/1991 Kaczmarczyk ..... 414/723

FOREIGN PATENT DOCUMENTS 8712513 1/1988 Germany .
2131391 6/1984 United Kingdom .
8801322 2/1988 WIPO .

*Primary Examiner*—Donald W. Underwood
*Attorney, Agent, or Firm*—Townsend & Townsend Khourie & Crew

[57] ABSTRACT

A latching mechanism for connecting a working implement to a front end loading tractor or other heavy load carrying machinery. The latching mechanism has a plate assembly, a pivotal coupling device, a cross rod mounted on the tractor, a latch device, and a locking device for releasably retaining a first and a second pivotable members. The pivotal coupling device includes a coupling formed on the plate assembly, and a receiver formed on the tractor for relatively rotatably receiving the coupling. The latch device includes the first and second pivotable members attached to the plate assembly to be pivotable between a first position and a second position. The first and second pivotable members define recesses having an opening for receiving the cross rod when in the first position. The opening is closed when the pivotable members are in the second position, to retain the cross rod received.

7 Claims, 9 Drawing Sheets

LATCHING MECHANISM FOR A FRONT END LOADING TRACTOR

BACKGROUND OF THE INVENTION

1. Field of the Invention

The present invention relates to a latching mechanism for use in connecting a working implement to a front end loading tractor or other heavy load carrying machinery. This latching mechanism includes, as main components thereof, a cross rod mounted on one of the tractor and working implement, and a latch device mounted on the other for receiving and retaining the cross rod.

2. Description of the Related Art

The above latching mechanism is disclosed in U.S. Pat. No. 4,846,624, for example. This patent discloses a coupling device for coupling a tractor and a working implement in a way to allow side to side rocking movement relative to each other, and a pivot latch device having a receiving slot for receiving and retaining a cross pin mounted on the working implement. A similar latching mechanism is disclosed also in U.S. Pat. No. 4,986,722.

The known latching mechanism noted above allows the tractor and working implement to be coupled easily without an irksome operation using a bolt or the like. However, the known mechanism has a disadvantage due to the fact that the slot of the latch device has a fixed width. Where the slot has an increased width to facilitate insertion of the cross pin therein, a reliable fixed coupling is impaired by play between the slot and cross pin. Conversely, if the slot has a reduced width, a careful, tight fitting operation is required for inserting the pin into the slot.

SUMMARY OF THE INVENTION

An object of the present invention is to improve the conventional latching mechanism and provide a compact latching mechanism which assures a reliable coupling.

The above object is fulfilled, according to the present invention, by a latching mechanism comprising a pivotal coupling device including a coupling formed on one of a working implement and a tractor, and a receiver formed on the other for relatively rotatably receiving the coupling; a cross rod mounted on one of the working implement and the tractor; and a latch device for receiving and retaining the cross rod. The latch device includes a first pivotable member and a second pivotable member pivotable between a first position and a second position. The first and second pivotable members define recesses having an opening for receiving the cross rod when in the first position, the opening being closed when the pivotable members are in the second position to retain the cross rod received. A cam device is formed in regions of the recesses of the first and second pivotable members to be operable by a pressing force of the cross rod to pivot the first and second pivotable members toward the second position. The first and second pivotable members are biased by a biasing device toward the first position. A locking device is provided for maintaining the first and second pivotable members in the second position.

When attaching a working implement such as a backhoe to a tractor, the coupling formed on the working implement is rotatably connected to the receiver formed on the tractor. Next, the working implement is pivoted about the coupling toward the tractor. Then the cross rod formed on one of the tractor and working implement is inserted between a pair of pivotable plates formed on the other. The cross rod pushes cams formed in the pivotable plates to close the pivotable plates. As a result, the cross rod is connected to the pivotable plates. At this time, the locking device is caught between the pivotable plates to prevent opening of the latter. In this way, the working implement is attached to the tractor easily and reliably. This attaching operation is carried out in a short time and without requiring a tool.

The foregoing and other objects, features and advantages of the invention will be apparent from the following more particular description of preferred embodiments of the invention, as illustrated in the accompanying drawings.

DESCRIPTION OF THE PREFERRED EMBODIMENTS

Figure 7:
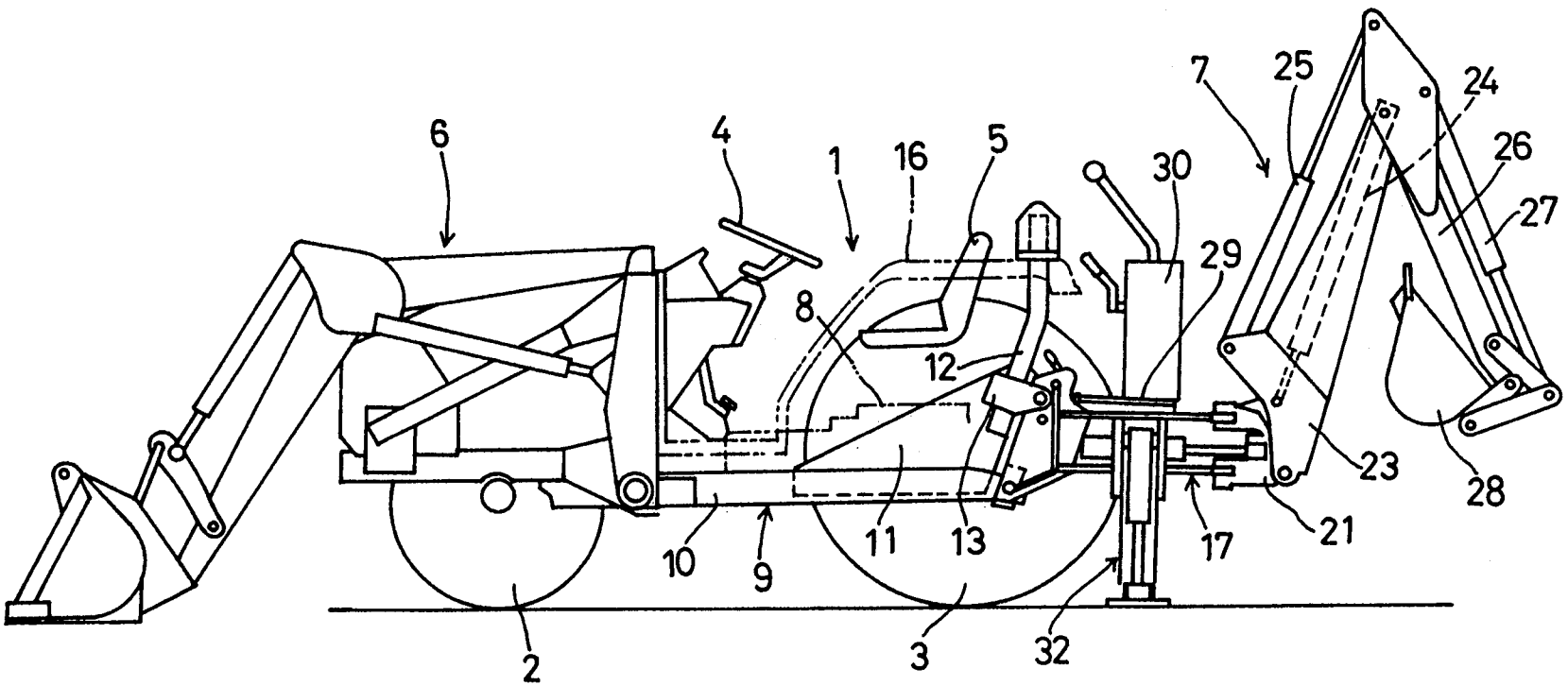
FIG. 7 is a side elevation of the tractor.

Embodiments of the present invention will be described hereinafter with reference to the drawings. FIGS. 1 through 7 show a first embodiment. Referring to FIG. 7 first, numeral 1 denotes a tractor having front wheels 2 and rear wheels 3. A driver's seat 5 is disposed rearwardly of a steering wheel 4. The seat 5 is switchable between a forwardly facing position and a rearwardly facing position. The tractor 1 has a front loader 6 connected to the front end thereof, and a backhoe 7 connected to the rear end.

In FIG. 7, numeral 8 denotes a body of the tractor 1 including an engine, a transmission case and the like directly connected to one another. The body 8 has mounting frames 9 attached to opposite lateral positions thereof for coupling the backhoe 7. As also shown in FIGS. 1 through 6, each of the right and left mounting frames 9 includes a main frame 10 fixed to a lower position of the body 8 to extend longitudinally thereof, a side frame 11 fixed to an outer side of a rear portion of the main frame 10 and projecting upward therefrom, and a vertical reinforcing frame 12 in the form of a square pipe fixed at a lower position thereof between the side frame 11 and a plate 13 spaced inwardly from an upper rearward portion of the side frame 11.

The main frame 10 has U-shaped recess formed in a rear end region thereof and opening upwardly and rearwardly to act as a coupling receiver 14. A cross rod 15 having an axis extending transversely of the tractor is fixedly mounted above the coupling receiver 14 and rearwardly of the vertical reinforcing frame 12 between the side frame 11 and plate 13. The vertical reinforcing frame 12 extends upward along a vertical inner surface of a rear fender 16 to be connected to an upper surface of the rear fender 16.

Figure 5:
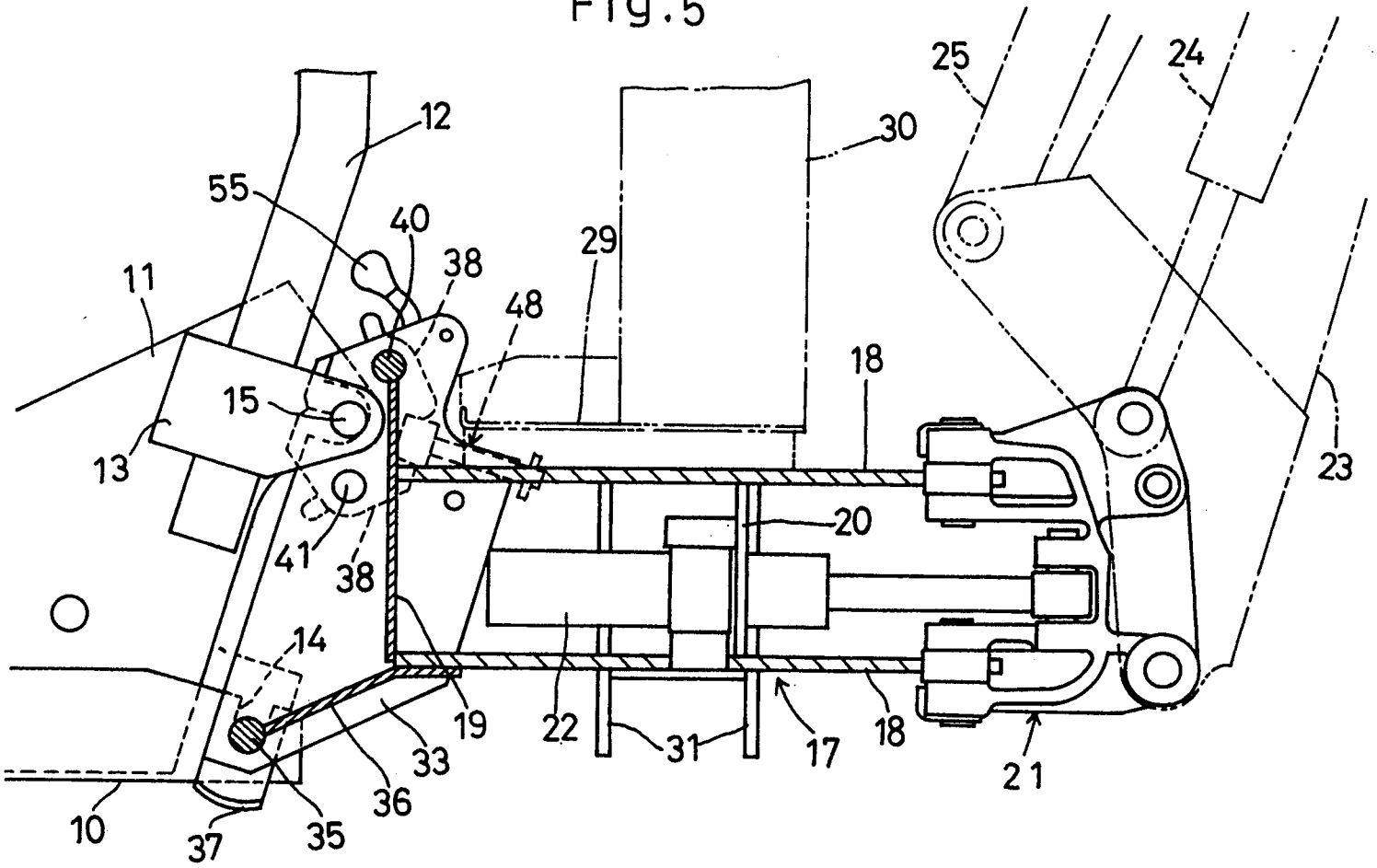
FIG. 5 is a sectional side view of a proximal portion of a backhoe.
Figure 6:
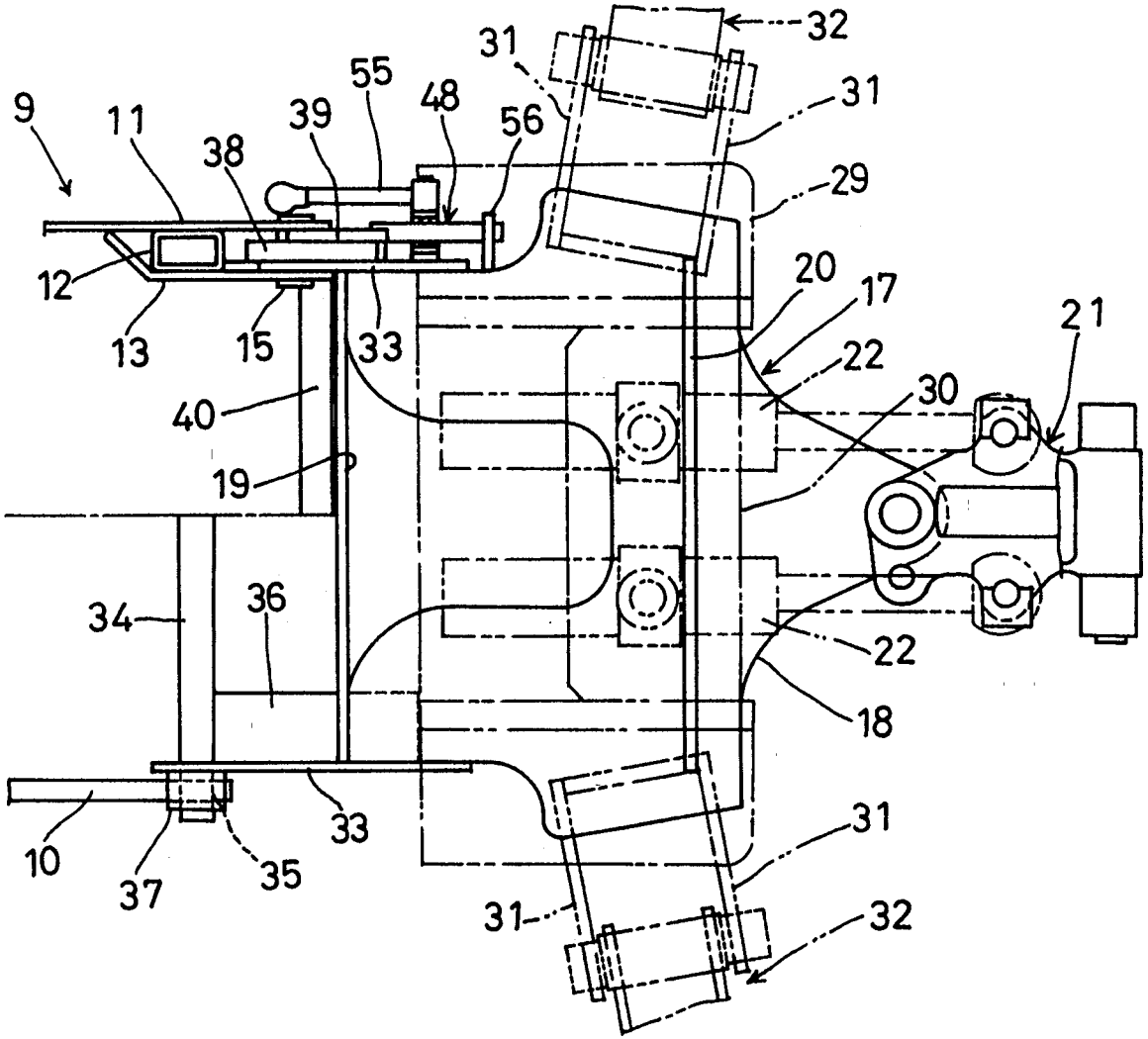
FIG. 6 is a sectional plan view of the proximal portion of the backhoe.

As shown in FIG. 5, the backhoe 7 has a base frame 17 including a pair of upper and lower main frames 18, a front frame 19 interconnecting forward ends of the upper and lower main frames 18, and an intermediate frame 20 interconnecting intermediate positions of the main frames 18. A swing frame 21 is connected to rear ends of the upper and lower main frames 18 to be pivotable fight and left about a vertical axis. The swing frame 21 is pivotable by a pair of fight and left swing cylinders 22. A boom 23 has a proximal end thereof pivotally connected to a lower position of the swing frame 21 to be vertically pivotable by a boom cylinder 24. An arm 26 has a proximal end thereof connected to a distal end of the boom 23 to be pivotable by an arm cylinder 25.

A bucket 28 is connected through a link mechanism to a distal end of the arm 26 to be pivotable by a bucket cylinder 27. A step 29 is provided on the base frame 17 for supporting a control box 30. Outriggers 32 are vertically pivotably connected to opposite sides of the base frame 17 through brackets 31.

As shown in FIG. 5, side plates 33 am fixed to opposite sides of the front of the base frame 17. A coupling bar 34, see FIG. 6, extends transversely between lower positions of the side plates 33. Opposite ends of this coupling bar 34 project outwardly from the side plates 33 to extend through U-shaped mount guides 37 secured laterally outwardly of the side plates 33 to open downwardly. The projecting ends of the coupling bar 34 define couplings 35 for engaging, from above, the coupling receivers 14 provided on the tractor 1. The mount guides 37 have lower lateral walls curved outwardly. Each side plate 33 includes a reinforcing plate 36 formed on a lower inside wall thereof, which is secured to the lower main frame 18, side plate 33 and coupling bar 34.

As best shown in FIGS. 1 through 4, a vertically opposed pair of pivotable plates 38 is disposed laterally outwardly of each side plate 33 and above the coupling 35. As seen from FIG. 4, the pair of pivotable plates 38 is interposed between the side plate 33 and a guide plate 39 spaced laterally outwardly from the side plate 33. The respective pivotable plates 38 are supported on transverse support shafts 40 and 41 to be pivotable toward and away from each other. The support shaft 40 supporting the upper pivotable plate 38 extends between and interconnects right and left side plates 33. The support shafts 41 supporting the lower pivotable plates 38 are provided separately on the right and left sides of the tractor.

The upper and lower pivotable plates 38 have brackets 42 disposed in positions thereof remote from each other. The side plate 33 has pins 43 fixed thereto in positions rearwardly of the brackets 42. Biasing springs 44 in the form of tension coil springs extend between the brackets 42 and pins 43, respectively, to constantly bias the upper and lower pivotable plates 38 to open toward the tractor 1 (i.e. forwardly).

The upper and lower pivotable plates 38 have opposed surfaces defining arcuate recesses 45 for engaging the cross rod 15 formed on the mounting frame 9 of the tractor 1, and limiter surfaces 46 rearwardly of the recesses 45 for contacting each other to limit opening of the pivotable plates 38. Further, the opposed surfaces of the pivotable plates 38 are cut out rearwardly of the limiter surfaces 46 to diverge rearwardly from each other, thereby to define an engaging recess 47 for receiving a head 49 of a lock member 48 when the pivotable plates 38 are closed. The side plate 33 and guide plate 39 define U-shaped cutouts laterally of the recesses 45 not to interfere with the cross rod 15.

The lock member 48 is disposed rearwardly of the pivotable plates 38 to prevent opening of the pivotable plates 38 in a closed position. The lock member 48 includes the head 49 for engaging the engaging recess 47, and a shank 50 having a forward end thereof secured to an outer side of the head 49. A forward position of the shank 50 is penetrated by a pin 51 supported in slots formed in support brackets 52 arranged at opposite sides of the shank 50. The support brackets 52 are secured to a tubular element 54 rotatably mounted on a transverse support shaft 53 fixed to the side plate 33. A control lever 55 is secured to the tubular element 54. The shank 50 is axially movably supported at a rear end thereof by a support plate 56 secured to the main frame 18 of the base frame 17 of the backhoe 7. A compression coil spring 57 is mounted on the shank 50 between the support plate 56 and pin 51.

Figure 2:
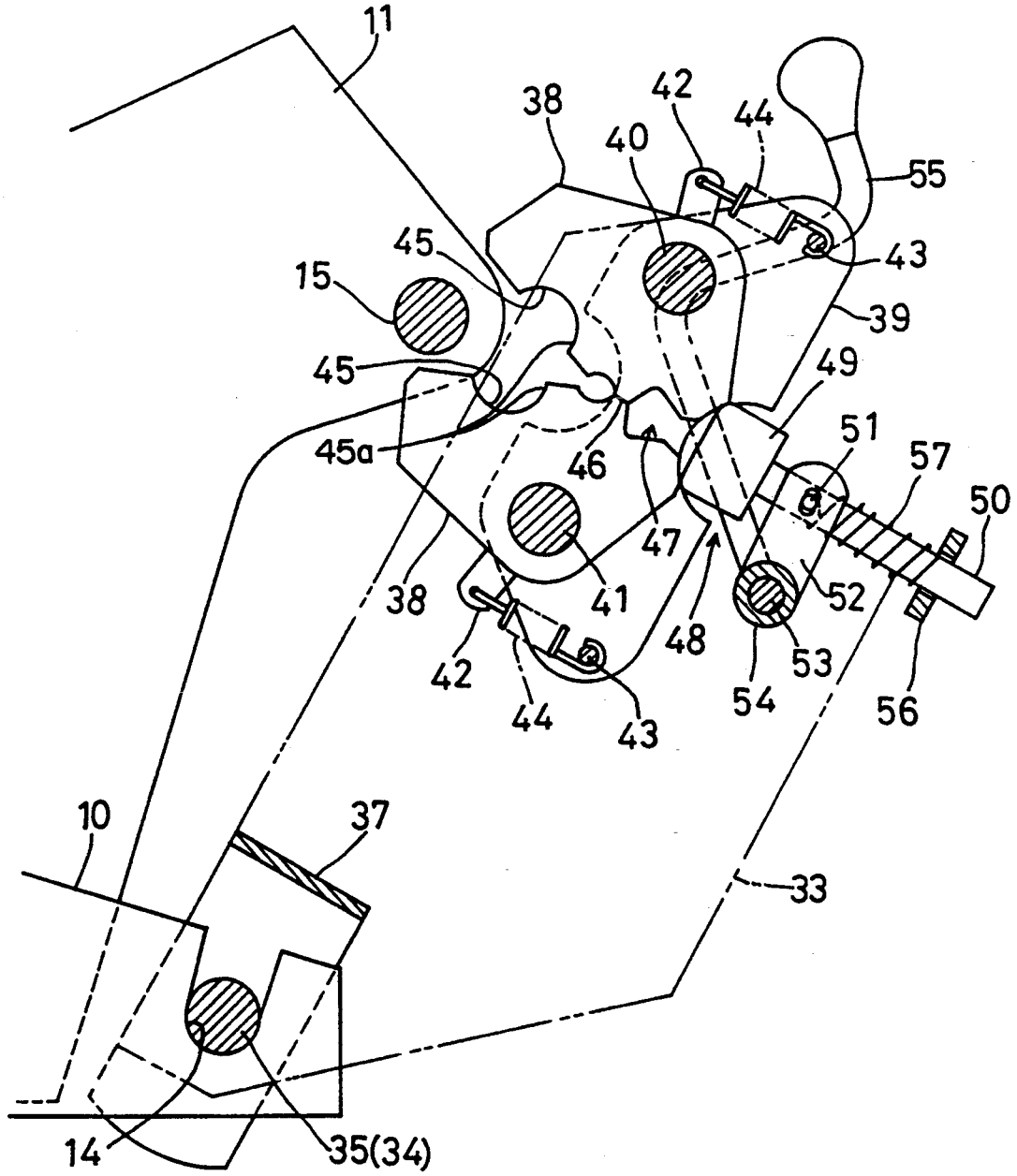
FIG. 2 is a sectional side view of the principal portion in which a cross rod and pivotable members are in-positions before contacting each other when the working implement is being attached.

How the backhoe 7 is connected to the tractor 1 with the above construction will be described step by step. First, the backhoe 7 detached from the tractor 1 is allowed to stand with the right and left outriggers 32 and arm 26 contacting the ground. In this state, the couplings 35 of the backhoe 7 are disposed above the coupling receivers 14 of the tractor 1. For attaching the backhoe 7 to the tractor 1, the tractor 1 is driven backward to place the coupling receivers 14 close below the couplings 35. Then the outriggers 32 is lowered to lower the backhoe 7, thereby fitting the couplings 35 into the coupling receivers 14 from above. The couplings 35 are now connected to the coupling receivers 14 to be rotatable about a transverse axis. At this time, the pivotable plates 38 are open and the cross rod 15 lies forwardly of the pivotable plates 38 as shown in FIG. 2. The head 49 of the lock member 48 is in contact with rear surfaces of the pivotable plates 38 under the biasing force of compression coil spring 57.

Figure 1:
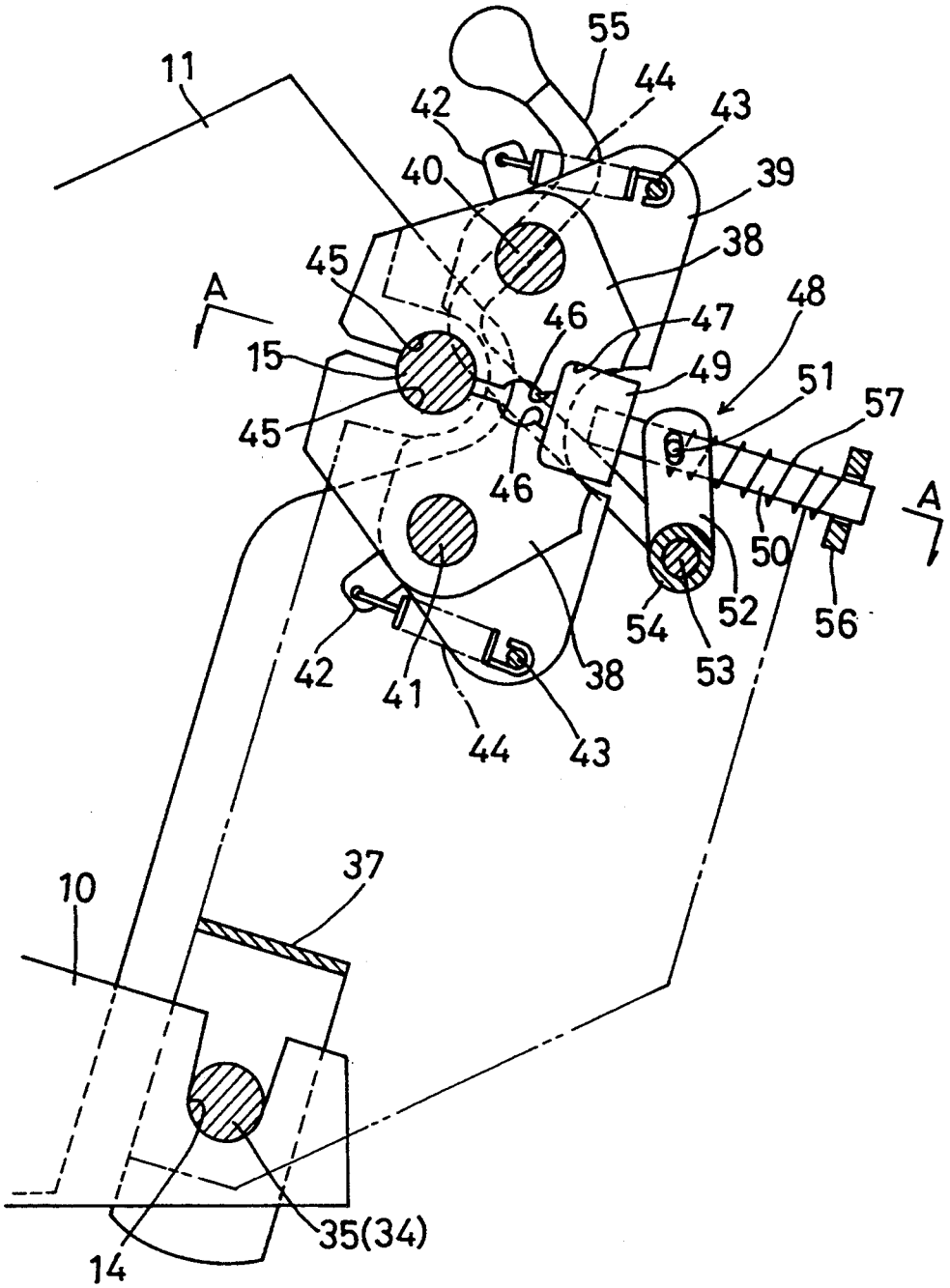
FIG. 1 is a sectional side view of a principal portion in a first embodiment with a working implement attached to a tractor.
Figure 3:
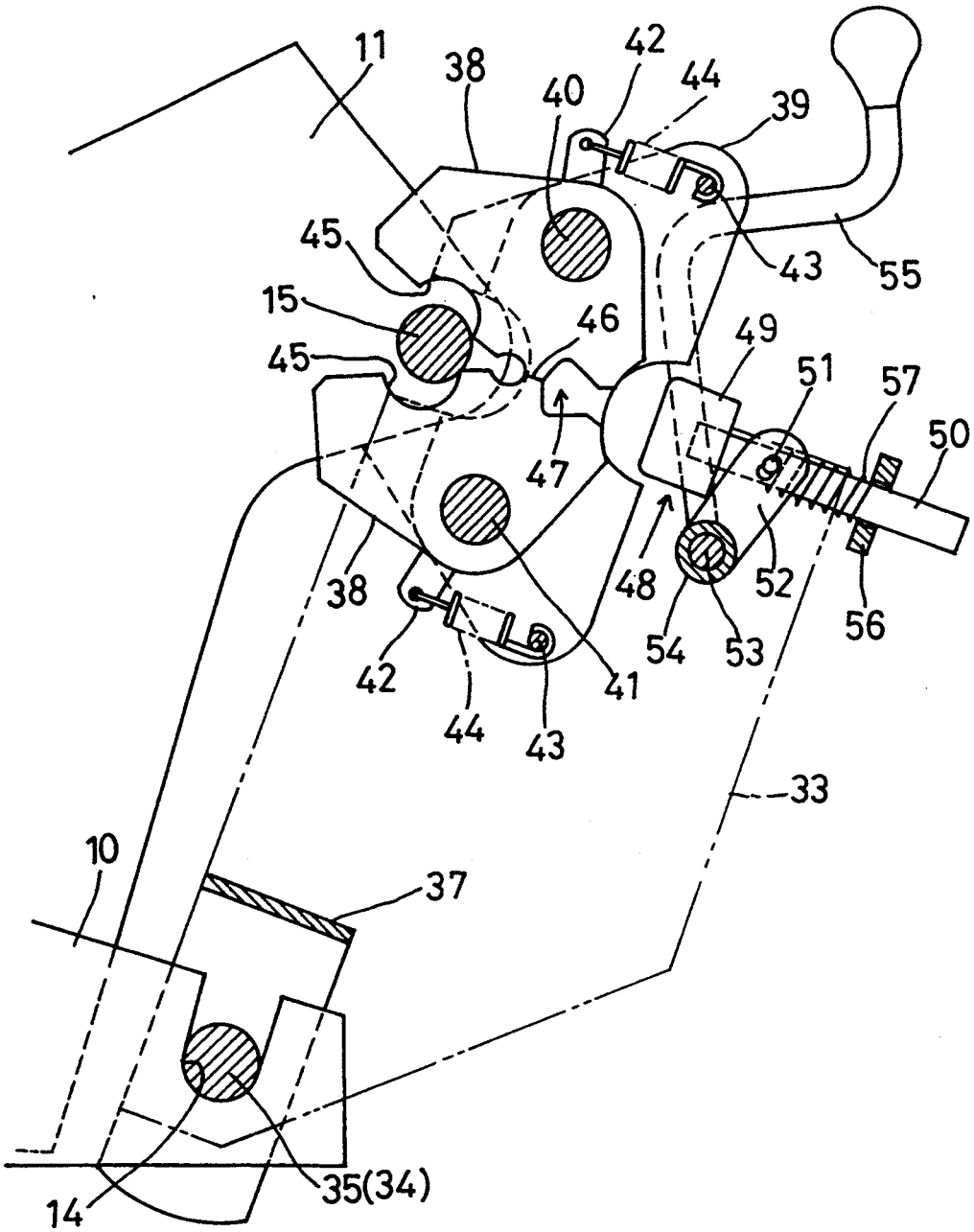
FIG. 3 is a sectional side view of the principal portion in which the cross rod and pivotable members have contacted each other when the working implement is being attached.
Figure 4:
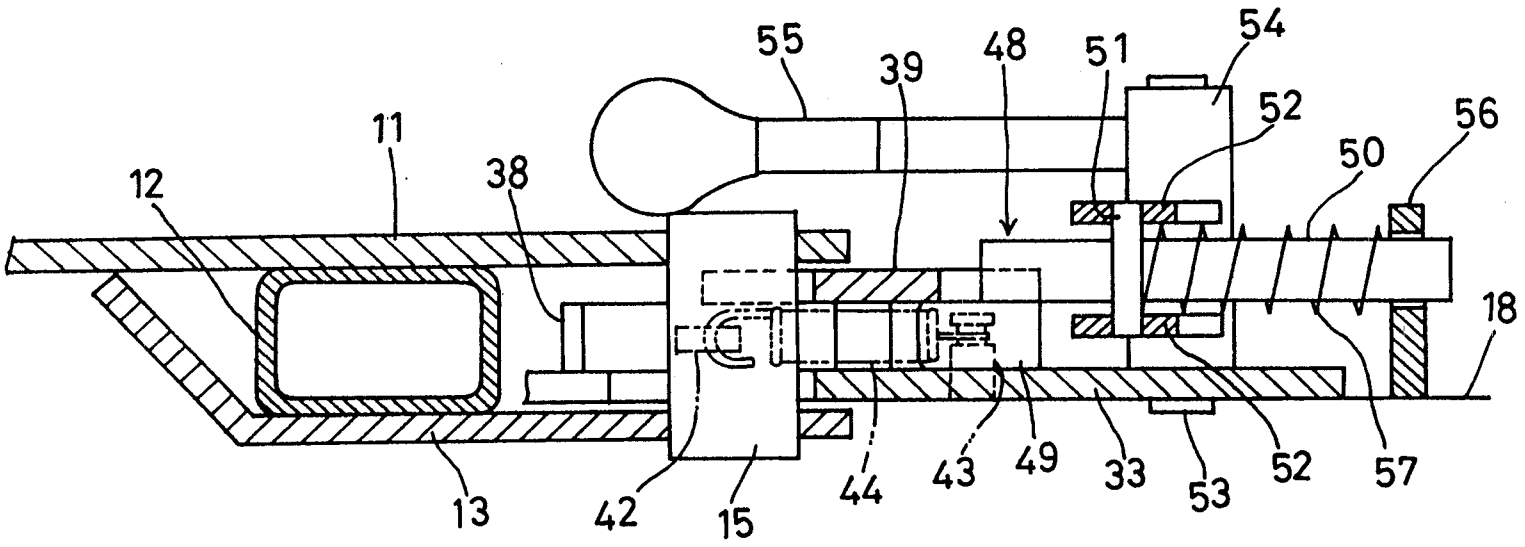
FIG. 4 is a section taken on line A—A of FIG. 1.

Next, the boom cylinder 24 is contracted to cause the base frame 17 of the backhoe 7 to pivot about the couplings 35, whereby the pivotable plates 38 move toward the tractor 1. Then, the cross rod 15 is inserted between the pivotable plates 38 as shown in FIG. 3. The cross rod 15 pushes rear ends **45*a* of the arcuate recesses 45 to cause the pivotable plates 38 to pivot in the closing directions against the biasing springs 44. Rear ends 45*a* of arcuate recess thus acts as a cam surfaces when contacted by cross rod 15. The cross rod 15 is now connected between the upper and lower pivotable plates 38. With the closing movement of the pivotable plates 38, the engaging recess 47 is opened, as shown in FIG. 1, to receive the head 49 of the lock member 48 constantly biased by the spring 57 against the rear ends of the pivotable plates 38. With the head 49 lying between the pivotable plates 38, the latter are prevented from opening. In this way, the backhoe 1 is connected to the tractor 1, with the base frame 17 of the backhoe 7 connected to the mounting frames 9**.

When disconnecting the backhoe 7, the control lever 55 is moved rearwardly to move the lock member 48 rearwardly and separate the head 49 from the engaging recess 47. This state is maintained. The lock member 48 may be maintained in this state manually or by means of a retaining device. Where this is done manually, the right and left lock members 48 preferably are interlocked to be operable by a single control lever. With the lock member 48 separated from the engaging recess 47, the pivotable plates 38 are opened under the biasing force of the springs 44. Subsequently, an operation reverse to the above may be carried out.

Figure 8:
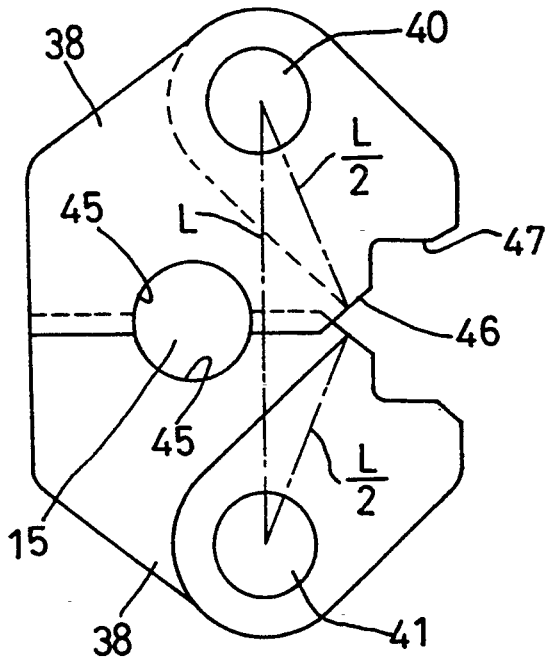
FIG. 8 is a side view of pivotable members in a second embodiment.
Figure 9:
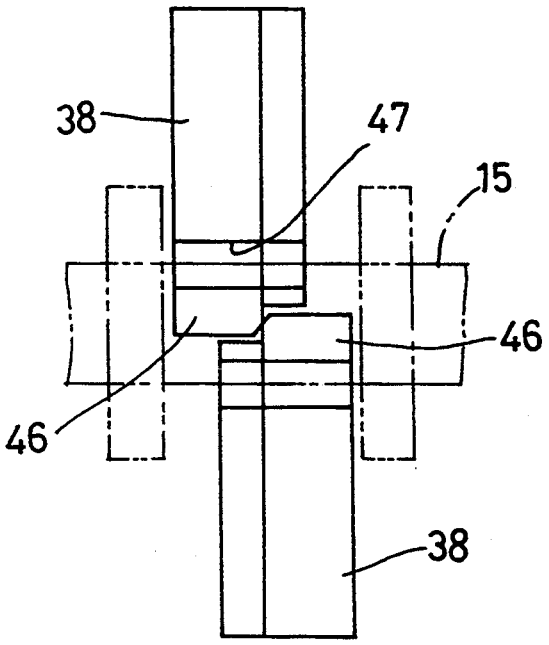
FIG. 9 is a rear view of the pivotable members in the second embodiment.

FIGS. 8 and 9 show a second embodiment, in which the upper and lower pivotable plates 38 are displaced sideways from each other, and overlap each other in positions forwardly and rearwardly of the arcuate recesses 45 in side view. This arrangement increases areas of contact between the pivotable plates 38 and cross rod 15 to reduce wear. The pivotable plates 38 have thick rear walls to allow contact between the limiter surfaces 46. Each limiter surface 46 is at a distance from the support shaft 40 or 41, which is half the distance between the two support shafts 40 and 41.

Figure 10:
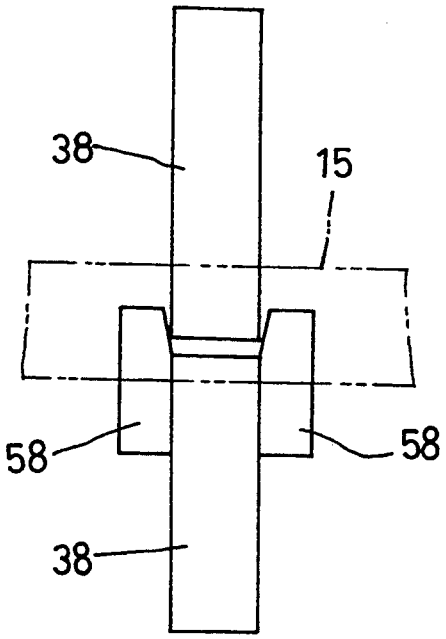
FIG. 10 is a rear view of pivotable members in a third embodiment.

FIG. 10 shows a third embodiment, in which one of the upper and lower pivotable plates 38 has reinforcements 58 formed on opposite side thereof. As a result, the pivotable plates 38 overlap each other in positions forwardly and rearwardly of the arcuate recesses 45 in side view.

Figure 11:
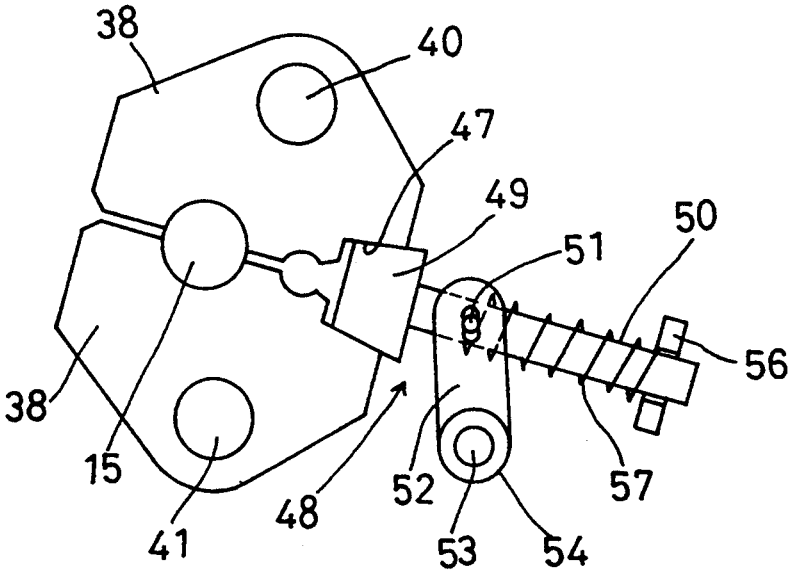
FIG. 11 is a side view of pivotable members and a lock member in a fourth embodiment.

FIG. 11 shows a fourth embodiment, in which the engaging recess 47 and the head 49 of the lock member 48 are tapered to prevent chattering when engaged.

What is claimed is:

1. A latching mechanism for connecting a working implement to a front end loading tractor or other heavy load carrying machinery, comprising:

a plate assembly attachable to said working implement;

a pivotal coupling assembly including a coupling formed on said plate assembly, and a receiver mountable on said tractor for relatively rotatably receiving said coupling;

a cross rod mountable on said tractor;

latch means including:

a first, upper pivotable member and a second, lower pivotable member attached to said plate assembly to be pivotable between a first position and a second position, said first and second pivotable members defining downwardly and upwardly facing recesses, said recesses defining a cross rod-receiving region when said pivotal members are in said second position, said recesses having an opening for receiving said cross rod when in said first position, said opening being closed when said pivotable members are in said second position to retain said cross rod received;

said recesses of said first and second pivotable members including cam means to be operable by a pressing force of said cross rod to pivot said first and second pivotable members toward said second position; and bias means for biasing said first and second pivotable members toward said first position; and lock means for maintaining said first and second pivotable members in said second position.

2. A latching mechanism as defined in claim 1, wherein said first pivotable member is formed as a first pivotable plate having an edge and being pivotally mounted about a first cross pin, and said second pivotable member is formed as a second pivotable plate having an edge and being pivotally mounted about a second cross pin such that said edges are mutually opposed, said recesses, including said cam means, being defined by geometric shapes of said mutually opposed edges of said first and second pivotable plates.

3. A latching mechanism as defined in claim 1, wherein said lock means includes a main body slidable between a lock position and an unlock position, said main body defining a contact portion at an end thereof for contacting engaging portions formed on said first and second pivotable members to prevent pivotal movement thereof from said second position.

4. A latching mechanism as defined in claim 3, further comprising biasing means for biasing said main body of said lock means to said lock position.

5. A latching mechanism as defined in claim 1, wherein said receiver is in the form of a U-shaped recess, and said coupling includes a cross bar extending through an entire width of said plate assembly.

6. A latching mechanism for connecting a working implement to a front end loading tractor or other heavy load carrying machinery, comprising:

a plate assembly attachable to said working implement;

a pivotal coupling assembly including a coupling formed on said plate assembly, and a receiver mountable on said tractor for relatively rotatably receiving said coupling;

a cross rod mountable on said tractor;

latch means including:

a first pivotable member and a second pivotable member attached to said plate assembly to be pivotable between a first position and a second position, said first and second pivotable members defining recesses having an opening for receiving said cross rod when in said first position, said opening being closed when said pivotable members are in said second position to retain said cross rod received;

cam means formed in regions of said recesses of said first and second pivotable members to be operable by a pressing force of said cross rod to pivot said first and second pivotable members toward said second position;

said first pivotable member being formed as a first pivotable plate having an edge and being pivotally mounted about a first cross pin, and said second pivotable member being formed as a second pivotable plate having an edge and being pivotally mounted about a second cross pin such that said edges are mutually opposed, said recesses and said cam means being defined by geometric shapes of said mutually opposed edges of said first and second pivotable plates;

bias means for biasing said first and second pivotable plates toward said first position; and lock means for maintaining said first and second pivotable plates in said second position.

7. A latching mechanism for connecting a working implement to a front end loading tractor or other heavy load carrying machinery, comprising:

a plate assembly attachable to said working implement;

pivotal coupling assembly including a coupling formed on said plate assembly, and a receiver mountable on said tractor for relatively rotatably receiving said coupling;

a cross rod mountable on a chosen one of said working implement and said tractor;

latch means including:

a first, upper pivotable member and a second, lower pivotable member attachable to the other of said working implement and the tractor to be pivotable between a first position and a second position, said first and second pivotable members defining downwardly and upwardly facing recesses, said recesses defining a cross rod-receiving region when said pivotal members are in said second position, said recesses having an opening for receiving said cross rod when in said first position, said opening being closed when said pivotable members are in said second position to retain said cross rod received;

cam means formed in regions of said recesses of said first and second pivotable members to be operable by a pressing force of said cross rod to pivot said first and second pivotable members toward said second position; and bias means for biasing said first and second pivotable members toward said first position; and lock means for maintaining said first and second pivotable members in said second position.

* * * * *